US005160128A

United States Patent [19]

Oishi

[11] Patent Number: 5,160,128

[45] Date of Patent: Nov. 3, 1992

[54] CLUTCH DEVICE FOR AUTOMATIC PAPER FEEDER

[75] Inventor: Harumichi Oishi, Higashi-Yamato, Japan

[73] Assignee: Daiwa Seiko, Inc., Tokyo, Japan

[21] Appl. No.: 675,818

[22] Filed: Mar. 27, 1991

[30] Foreign Application Priority Data

Apr. 11, 1990 [JP] Japan ..... 2-96829

[51] Int. Cl.[5] ..... B65H 3/06

[52] U.S. Cl. ..... 271/114; 271/116

[58] Field of Search ..... 271/114–116; 475/323, 324, 331, 903

[56] References Cited

U.S. PATENT DOCUMENTS 4,754,961 7/1988 Tokuda et al. ..... 271/114

FOREIGN PATENT DOCUMENTS 351243 3/1991 Japan ..... 271/114

*Primary Examiner*—David H. Bollinger

*Attorney, Agent, or Firm*—Kalish & Gilster

[57] ABSTRACT

The present invention relates to a clutch device for an automatic paper feeder which transfers rotary driving force from a drive shaft provided in a printer body to a feeding roller through proper timing control. The present invention includes a clutch gear which has an internal gear formed on its inner surface and an external gear formed on its outer surface, the external gear receiving rotary driving force transferred from a drive shaft of a printer body; a sun gear which is located coaxially with the clutch gear to transfer rotary driving force to a feeding roller shaft supporting the feeding roller and to receive rotary braking force of a braking mechanism; a planetary gear which is engaged with both the internal gear of the clutch gear and the sun gear; and a stopper which inhibits the planetary gear from revolving in a predetermined direction during the reverse rotation of the drive shaft of the printer body but does not inhibit the planetary gear from revolving in the opposite direction to the predetermined direction during the normal rotation of the drive shaft. Accordingly, the present invention can rotate the feeding roller in the feeding direction simultaneously with the reverse rotation of the drive shaft of the printer body and stop the feeding roller rotation simultaneously with the normal rotation of the drive shaft.

2 Claims, 11 Drawing Sheets

CLUTCH DEVICE FOR AUTOMATIC PAPER FEEDER

BACKGROUND OF THE INVENTION

1. Field of the Invention

This invention relates to a clutch device for an automatic paper feeder, and more particularly to a clutch device for an automatic paper feeder which transfers rotary driving force from a drive shaft provided in a printer body to a feeding roller through proper timing control.

2. Description of the Prior Art

A typical automatic feeder includes a feeding roller to hold uniform-size sheets of printing paper between a pressure plate and itself, and separates and feeds them one by one to the attached printer through the rotation of the feeding roller. To avoid possible paper skew and other problems during the feeding operation, for example, a normal rotation feeding clutch mechanism as disclosed in the Japanese Utility Model Application Laid-open No. 163332/1987 is adopted in the feeder. That normal rotation feeding technique is intended to separate and feed the sheets of paper installed in the feeder one by one to a platen of the printer by rotating the feeding roller simultaneously with the normal rotation (the rotation in the feeding direction) of the platen. During the separation and the feeding before the sheet is caught by the platen, the sheet may slant against the feeding direction for some reason, which is called skew. To avoid this skew, when the front edge of the sheet reaches the platen, that technique stops the feeding roller and at the same time, reversely rotates the platen to provide a flexure with the sheet, and then normally rotates the platen for feeding.

When the normal rotation feeding technique described above is used to avoid skew, the printer is required to include a controller which controls the timing for switching the platen rotation from normal to reverse and then to normal, and its clutch mechanism is required to include an origin detecting mechanism which cooperates with the controller. Moreover, the control operation is quite complicated because proper timing control is indispensable for driving and stopping the feeding roller.

Accordingly, the prior automatic feeder using the normal rotation feeding technique must have a complicated controller in the printer body to control the feeder, and the clutch mechanism must consist of many parts. These requirements make the feeder very heavy and expensive.

SUMMARY OF THE INVENTION

The present invention has been developed to overcome the disadvantages of the prior automatic feeder. It is, therefore, an object of the present invention to provide a clutch device for an automatic paper feeder, which is controlled by a relatively simple controller provided in a printer body and configured into a simple structure of fewer necessary parts to easily switch the rotation and stop operations of a feeding roller.

According to the present invention, the feeding roller can rotate in the feeding direction simultaneously with the reverse rotation of a drive shaft of the printer and stop its rotation simultaneously with the normal rotation of the drive shaft. This enables simple switching of the feeding roller operation between rotation and stop and also reduces necessary parts.

Moreover, because a dedicated motor is eliminated by the present invention, the automatic feeder can be assembled more easily and lighter than the prior arts.

DESCRIPTION OF THE PREFERRED EMBODIMENT OF THE INVENTION

Referring to the attached drawings, embodiments of the present invention will be described below in detail.

FIGS. 1 through 5 show a clutch device for an automatic paper feeder according to the first embodiment of the present invention.

Figure 1:
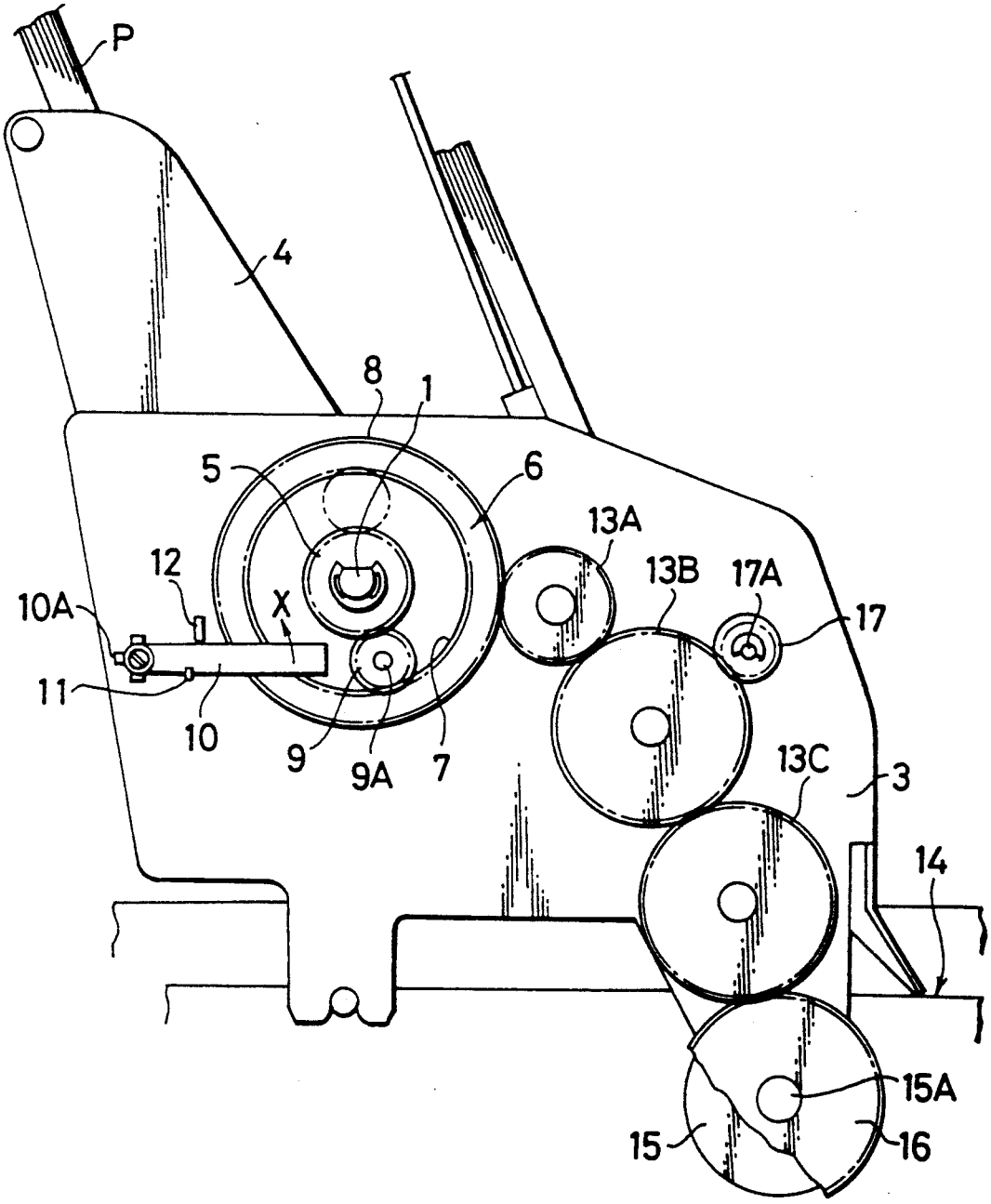
FIG. 1 is a side elevation of a clutch device for an automatic paper feeder according to the first embodiment of the present invention.
Figure 2:
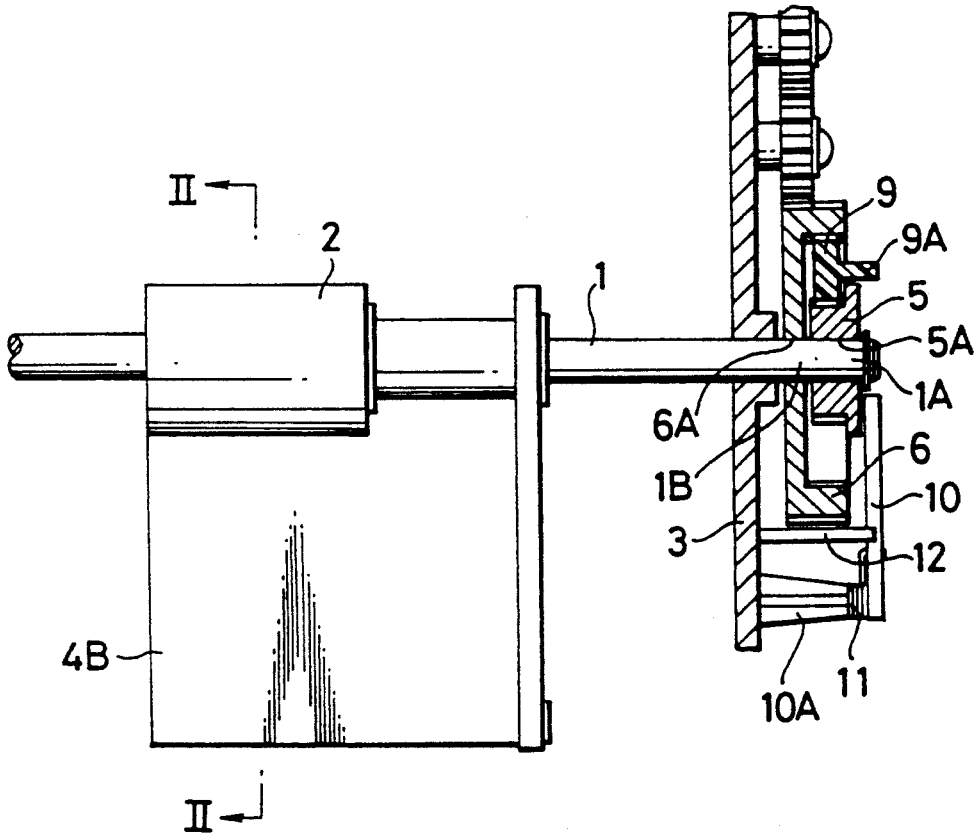
FIG. 2 is a cross section of the clutch device for the automatic paper feeder shown in FIG. 1.
Figure 3:
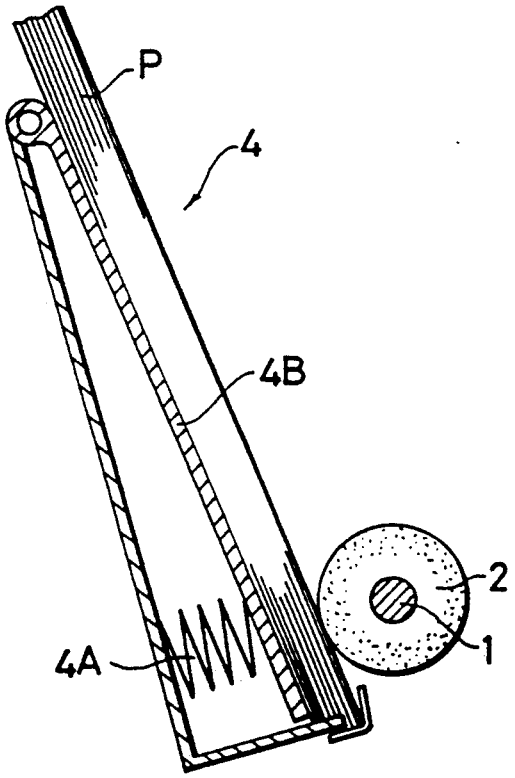
FIG. 3 is a transverse cross section taken on line II—II of FIG. 2.

In FIGS. 1 through 3, the reference numeral 1 shows a feeding roller shaft, on which a feeding roller 2 is fixed and one end of which is rotatably supported by a side plate 3. The numeral 4 shows a feeding hopper, which has a pressure plate 4B pushed toward the feeding roller 2 with a spring 4A. Printing paper P held on the pressure plate 4B is pressed against the feeding roller 2.

The feeding roller shaft 1 has a shaft portion 1A of a D cross section formed on its end portion outside the side plate 3. On the shaft portion IA, a center hole 5A of a sun gear 5 is fit to fix the sun gear 5 on the feeding roller shaft 1. The feeding roller shaft 1 also has another shaft portion 1B of a circle cross section formed on the same end portion outside the side plate 3. On the shaft portion 1B, a center hole 6A of a clutch gear 6 is loose fit. The sun gear 5 and the clutch gear 6 are coaxially located on the feeding roller shaft 1.

The clutch gear 6 has an internal gear 7 formed on its inner surface and an external gear 8 formed on its outer surface.

The numeral 9 shows a planetary gear, which is engaged with both the internal gear 7 of the clutch gear 6 and the sun gear 5 and has a pin 9A projecting at its center.

The side plate 3 has a gear stopper stud 10A attached thereto and on the gear stopper stud 10A, a gear stopper 10 formed of a bar is pivotally supported. The gear stopper stud 10A has a torsion spring 11 attached thereto and the torsion spring 11 pushes the gear stopper 10 in the direction shown by the arrow X so that the gear stopper 10 is held against another stopper 12 fixed on the side plate 3 to inhibit the pivot of the gear stopper 10.

The side plate 3 has a first gear 13A engaged with the external gear 8 of the clutch gear 6, a second gear 13B engaged with the first gear 13A, and a third gear 13C engaged with the second gear 13B, each being axially supported on the side plate 3. The third gear 13C is engaged with a platen gear 16 fixed on the drive shaft 15A which supports a platen 15 of a printer body 14.

The torsion spring 11 causes the stopper 12 to inhibit the clockwise revolution of the planetary gear 9 when the drive shaft 15A of the printer body 14 reversely rotates and not to inhibit the counterclockwise revolution of the planetary gear 9 when the drive shaft 15A normally rotates.

In the drawings, the numeral 17 shows a paper ejection roller gear engaged with the second gear 13B. The paper ejection roller gear 17 rotates a paper ejection roller shaft 17A.

Now referring to FIGS. 4 and 5, the operation of the present embodiment will be described below.

Figure 4:
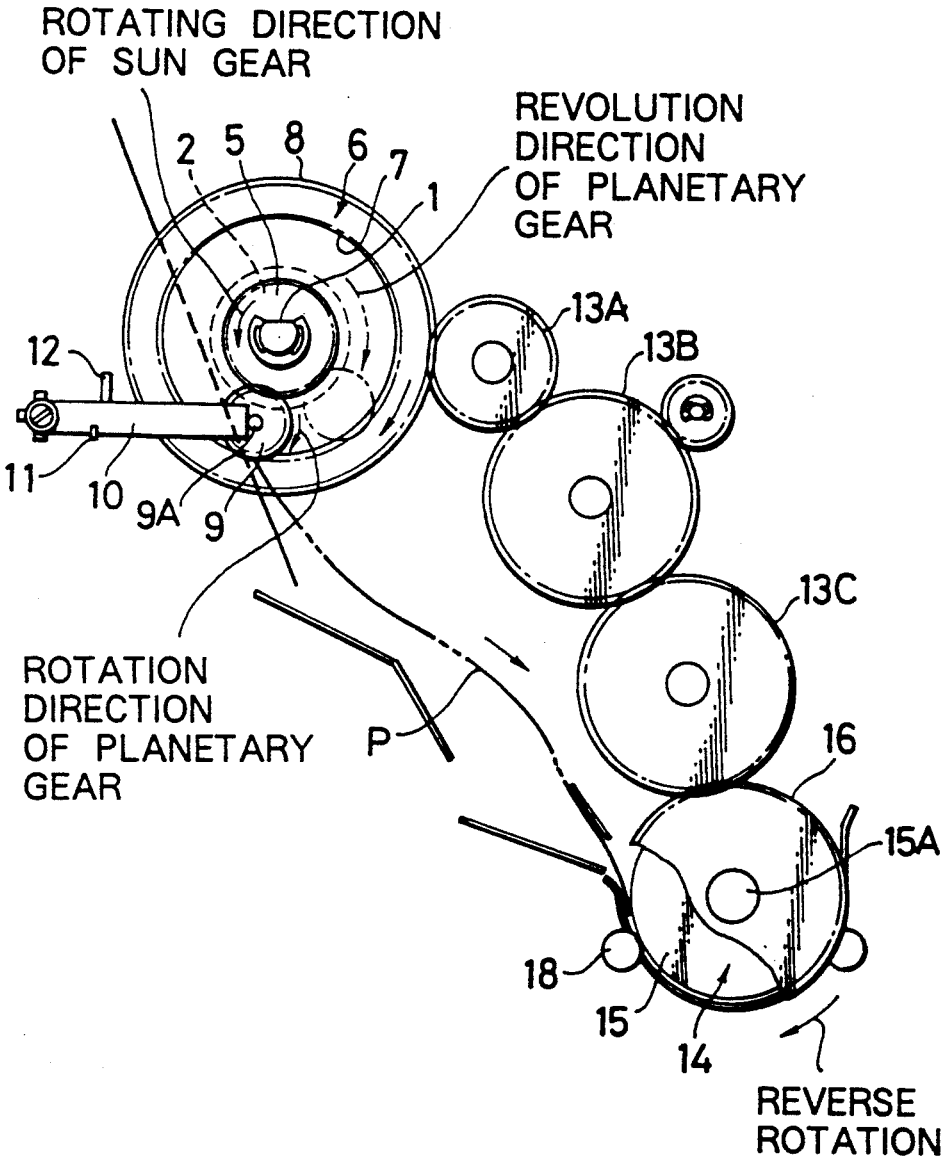
FIG. 4 is an explanatory view of the operating state of the clutch device when the drive shaft of the printer reversely rotates.

FIG. 4 shows the clutch-on state of the present clutch device.

When a switch (not shown) of the automatic feeder is turned on, a controller (also not shown) causes the drive shaft 15A of the printer body 14 to reversely rotate for a predetermined time. While the drive shaft 15A reversely rotates, the clutch device is in the clutch-on state for a predetermined time and the reverse rotation of the drive shaft 15A of the printer body 14 causes the feeding roller 2 to rotate in the feeding direction (the counterclockwise direction).

The rotation of the feeding roller 2 causes the printing paper P held in the feeding hopper 4 to be separated and fed sheet by sheet. When the front edge of each sheet reaches the platen 15 of the printer body 14, the contact area between the platen 15 and a pinch roller 18 inhibits further feeding of the paper P but the feeding roller 2 continues to rotate for feeding the rear portion of the paper P for a predetermined time. This makes the paper P curved.

Figure 5:
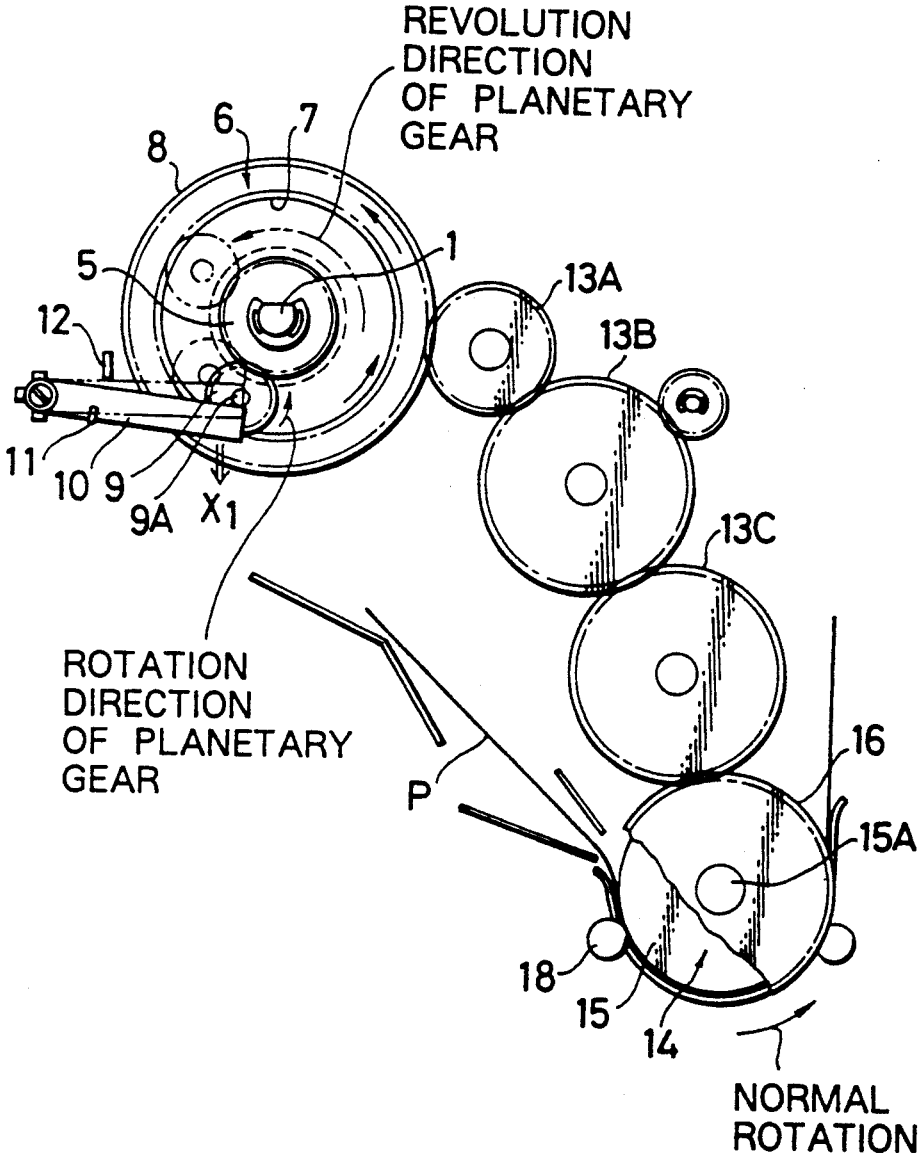
FIG. 5 is an explanatory view of the operating state of the clutch device when the drive shaft normally rotates.

The clutch device is turned off after the predetermined clutch-on time and goes into the state shown in FIG. 5 (the clutch-off state).

In the clutch-off state, the platen 15 of the printer body 14 normally rotates but the feeding roller 2 does not rotate with no paper P fed by the automatic feeder. The paper P caught by the contact area between the platen 15 and the pinch roller 18 is fed by the normally rotating platen 15 into the printer body 14 for printing.

Now the clutch-on and clutch-off operations of the clutch device will be described in detail below.

Because the printing paper P is held between the pressure plate 4B and the feeding roller 2 as shown in FIG. 3, the feeding roller shaft 1 bears some load, which acts as a predetermined rotary braking force on the roller shaft 1, and finally the predetermined rotary braking force is exerted on the sun gear 5 through the feeding roller shaft 1.

First, the clutch-on state will be described below, referring to FIG. 4.

When the drive shaft 15A of the printer body 14 reversely rotates, the rotary driving force of the drive shaft 15A is transferred through the third gear 13C, the second gear 13B, and the first gear 13A in this order to the external gear 8 of the clutch gear 6 to rotate the gear 6 clockwise. Then, because of the predetermined rotary braking force exerted on the sun gear 5 as described above, while its rotation is inhibited, the planetary gear 9 engaged with the internal gear 7 of the clutch gear 6 rotates on its axis and revolves clockwise around the sun gear 5.

When the pin 9A of the planetary gear 9 revolves clockwise and contacts with the gear stopper 10, the planetary gear 9 continues to rotate on its axis while its revolution is inhibited by the gear stopper 10. The rotation of the planetary gear 9 causes the sun gear 5 to overcome the rotary braking force and rotate again and the rotary driving force of the sun gear 5 is transferred to the feeding roller shaft 1 to rotate the feeding roller 2 in the feeding direction.

Next, the clutch-off state will be described below, referring to FIG. 5.

When the drive shaft 15A of the printer body 14 normally rotates, the rotary driving force of the drive shaft 15A is transferred through the third gear 13C, the second gear 13B, and the first gear 13A in this order to the external gear 8 of the clutch gear 6 to rotate the gear 6 counterclockwise. Then, because of the predetermined rotary braking force exerted on the sun gear 5 as described above, while its rotation is inhibited, the planetary gear 9 engaged with the internal gear 7 of the clutch gear 6 rotates on its axis and revolves counterclockwise around the sun gear 5. That revolution of the planetary gear 9 is not inhibited by the gear stopper 10 because the stopper 10 pushed by the pin 9A moves in the $X_1$ direction from one position shown by the two-dot chain line to another shown by the solid line while the planetary gear 9 continues to revolve without being inhibited by the gear stopper 10.

The revolution of the planetary gear 9 inhibits the rotary driving force from being transferred to the sun gear 5 and the rotary driving force from being transferred from the drive shaft 15A of the printer body 14 to the feeding roller shaft 1, so that the feeding roller 2 is in the stopped state.

With the configuration described above, the feeding roller 2 can rotate in the feeding direction simultaneously with the reverse rotation of the drive shaft 15A of the printer body 14 and can stop simultaneously with the normal rotation of the drive shaft 15A. Therefore, the present invention can switch the rotation and stop operations of the feeding roller 2 more easily and can provide a lighter automatic feeder made of fewer necessary parts and assembled more easily than the prior feeder.

In addition, as compared with the prior automatic feeder requiring an origin detecting mechanism in the clutch mechanism, the present embodiment does not require such an origin detecting mechanism for the clutch gear 6 because of the predetermined clutch-on times. The driving force transfer system or the feeding roller shaft according to the present embodiment does not require any expensive one-way clutch, resulting in an inexpensive automatic feeder.

It will be appreciated that, according to the present embodiment, the controller (not shown) directs the drive shaft 15A of the printer body 14 to reversely rotate for a predetermined time when the switch (also not shown) of the automatic feeder is turned on and that the clutch-on time depends on the reverse time of the drive shaft 15A. However, a paper sensor may be provided around the pinch roller 18 to detect the front edge of the paper P so that the drive shaft 15A can reversely rotate for a predetermined time (clutch-on time) after the edge is detected.

It will be further appreciated that, according to the present embodiment, a braking means for exerting the rotary braking force on the sun gear 5 is implemented with the pressure plate 4B pushed by the spring 4A. However, that braking means is not limited to this embodiment. For example, the braking means may be implemented so that a flat spring or the like pushes the outer surface of the sun gear 5 or a friction member pushes the circumferential surface of the feeding roller shaft 1 to exert a predetermined braking force on the roller shaft 1.

Figure 6:
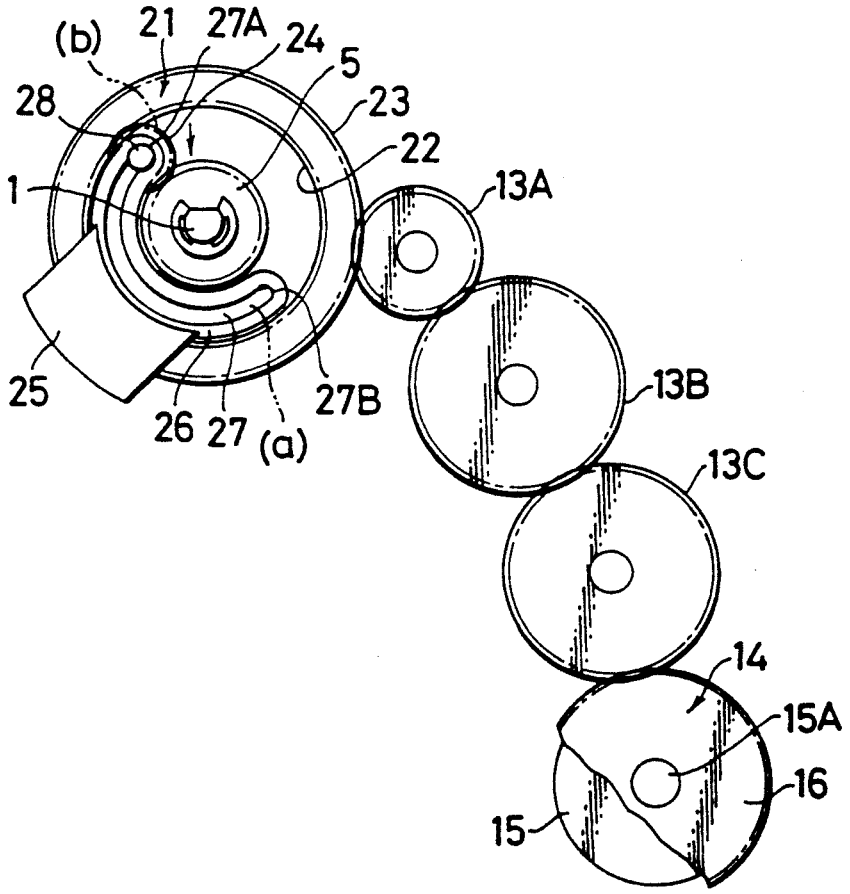
FIG. 6 is a side elevation of an automatic feeder clutch device according to the second embodiment of the present invention.
Figure 7:
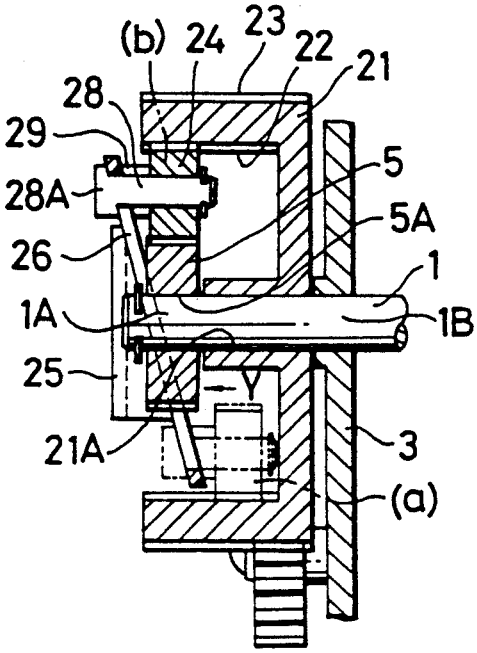
FIG. 7 is a cross section of the clutch device shown in FIG. 6.
Figure 8:
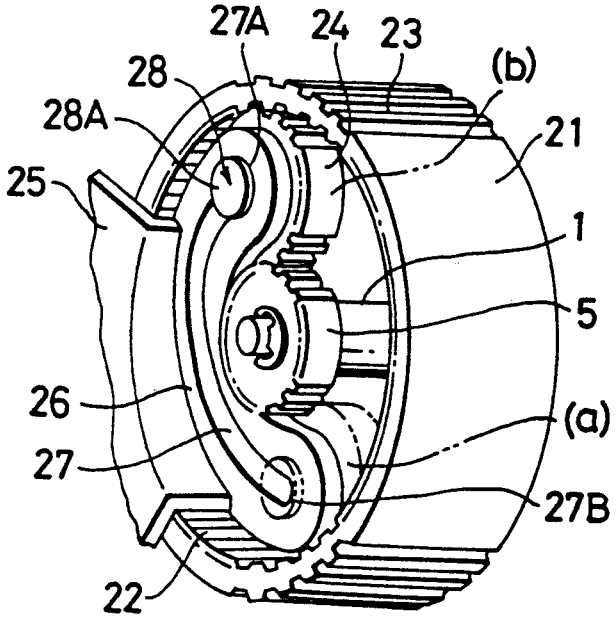
FIG. 8 is a perspective view of the clutch device shown in FIG. 6.

FIGS. 6 through 8 show another clutch device for an automatic paper feeder according to the second embodiment of the present invention.

The second embodiment has a similar configuration to that of the first embodiment described above and differences between them are only described below. In those drawings, components similar to those previously described with reference to the first embodiment are denoted by the same reference numerals.

As shown in the drawings, a feeding roller shaft 1 has a shaft portion 1A of a D-shaped cross section formed on its end portion outside a side plate 3. On the shaft portion 1A, a center hole 5A of a sun gear 5 is fit to fix the sun gear 5 on the feeding roller shaft 1. The feeding roller shaft 1 also has another shaft portion 1B of a circle cross section formed on the same end portion outside the side plate 3. On the shaft portion 1B, a center hole 21A of a clutch gear 21 is loose fit. The sun gear 5 and the clutch gear 21 are coaxially located on the feeding roller shaft 1.

The clutch gear 21 is a bottom-closed cylinder having an internal gear 22 formed on its inner surface and an external gear 23 formed on its outer surface.

With both the internal gear 22 of the clutch gear 21 and the sun gear 5, a planetary gear 24 is engaged.

On the side plate 3, a cam support plate 25 is fixed to support a cam plate 26 on its end. The cam plate 26 is semicircularly bent with a semicircular guide groove 27 formed in it and inclined toward the longitudinal direction of the feeding roller shaft 1. The longitudinal distance between both ends of the cam plate 26 is larger than the tooth thickness of the sun gear 5.

In the guide groove 27 of the cam plate 26, a guide shaft 28 of the planetary gear 24 is inserted. The cam plate 26 is held between a ring holder 28A on the end of the guide shaft 28 and a broach guide 29 annularly attached to the end of the guide shaft 28. A stopper 27A is formed at the upper end of the guide groove 27 and another stopper 27B at the lower end thereof.

The operation of the second embodiment will be described below.

The second embodiment performs basic operations similar to those of the first embodiment and differences between them are described first with respect to the clutch-on state of the clutch device.

The reverse rotation of the drive shaft 15A of the printer body 14 moves the planetary gear 24 (shown by the two-dot chain line) from the position (a) in the longitudinal direction of the feeding roller shaft 1 while the guide shaft 28 is guided along the guide groove 27 of the cam plate 26, resulting in the clockwise rotation and the clockwise revolution of the planetary gear 24. It should be noted that when the planetary gear 24 (shown by the two-dot chain line) is in the position (a), the gear 24 is engaged with the internal gear 22 of the clutch gear 21 but not with the sun gear 5.

When the planetary gear 24 revolves around the sun gear 5, the guide shaft 28 moves along the guide groove 27 of the cam plate 26 in the longitudinal direction of the feeding roller shaft 1 (the direction shown by the arrow Y).

The movement causes the planetary gear 24 to be engaged with the sun gear 5 tooth by tooth and finally to reach the position (b) and contact with the stopper 27A at the upper end of the guide groove 27. Then, the revolution is inhibited. Thus inhibited revolution of the planetary gear 24 causes the rotary driving force of the still rotating planetary gear 24 to be transferred to the sun gear 5, which overcomes the rotary braking force exerted by the spring 4A shown in FIG. 3 and begins to rotate counterclockwise to rotate the feeding roller 2. Then, the clutch device goes into the clutch-on state.

Next, the clutch-off state of the second embodiment will be described below.

The planetary gear 24 moves from the position (b) downward along the guide groove 27 of the cam plate 26 in the opposite direction to the end of the feeding roller shaft 1 (the opposite direction to the arrow Y).

When the revolving planetary gear 24 moves from the position (b) to the position (a), it is disengaged from the sun gear 5 and at the same time, its revolution is inhibited by the stopper 27B at the lower end of the guide groove 27. Then, the planetary gear 24 is engaged with the internal gear 22 of the clutch gear 21 to rotate counterclockwise. As the planetary gear 24 is not engaged with the sun gear 5, the feeding roller 2 which is rotated by the rotary driving force of the sun gear 5 stops and goes into the clutch-off state.

It will be appreciated that the second embodiment can have the same effect as that of the first embodiment.

FIGS. 9 through 12 show still another clutch device for an automatic paper feeder according to the third embodiment of the present invention.

The third embodiment has a similar configuration to that of the first embodiment described above and differences between them are only described below. In those drawings, components similar to those previously described with reference to the first embodiment are denoted by the same reference numerals.

Figure 9:
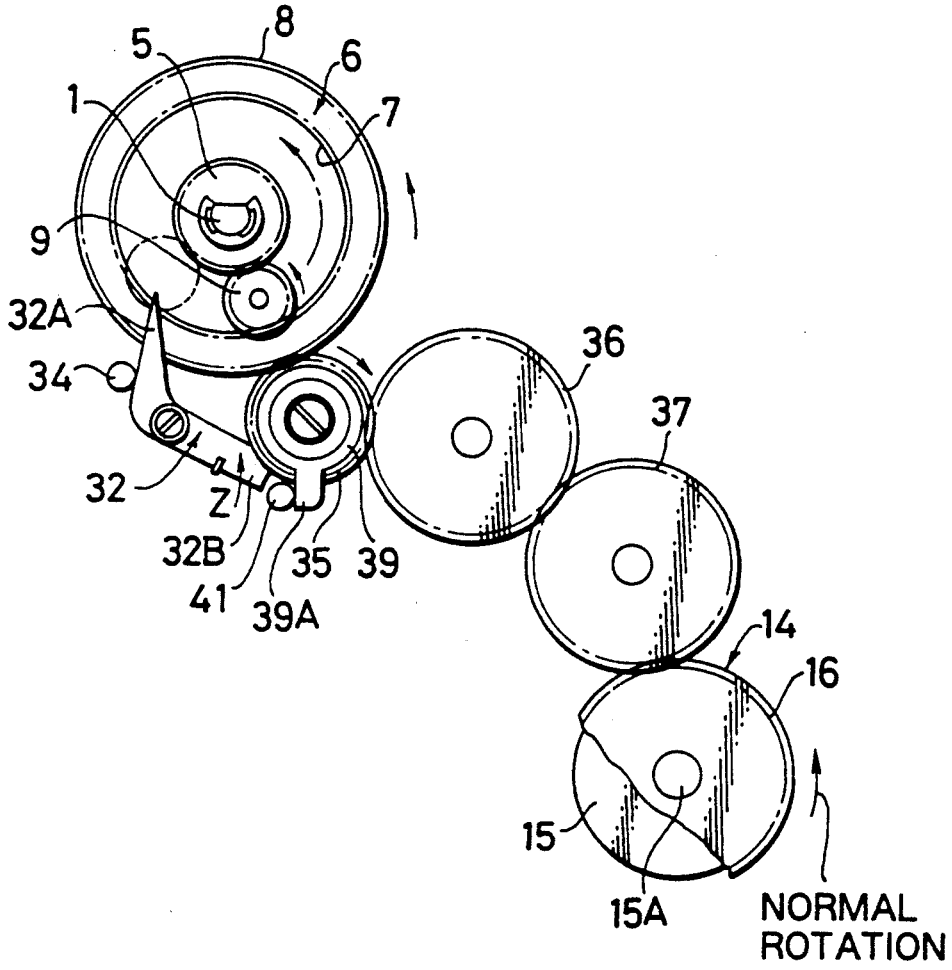
FIG. 9 is a side elevation of a clutch device for an automatic paper feeder according to the third embodiment of the present invention.
Figure 10:
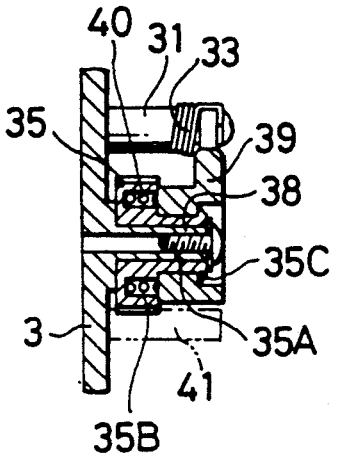
FIG. 10 is a cross section of a gear engaged with a clutch gear shown in FIG. 9 and some other parts around it.
Figure 11:
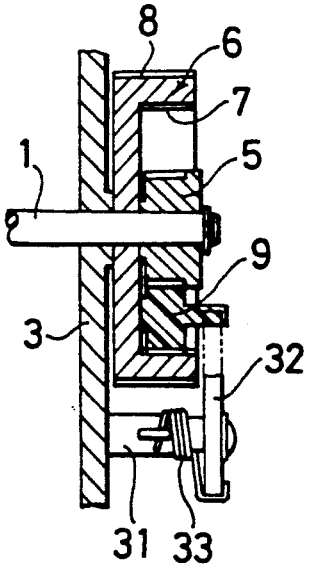
FIG. 11 is a cross section of a sun gear shown in FIG. 9 and some other parts around it.

In FIGS. 9 through 11, a side plate 3 has a stud 31 attached thereto and on the stud 31, a V-shaped gear stop lever 32 is pivotally supported. The stud 31 has a torsion spring 33 attached thereto and the torsion spring 33 pushes the gear stop lever 32 in the direction shown by the arrow Z so that one end 32A of the gear stop lever 32 is held against another lever stopper 34 fixed on the side plate 3 to inhibit the lever from pivoting.

The side plate 3 has a first gear 35 engaged with an external gear 8 of a clutch gear 6, a second gear 36 engaged with the first gear 35, and a third gear 37 engaged with the second gear 36, each being axially supported on the side plate 3. The first gear 35 has a cylindrical portion 35A formed at its center and an annular groove 35B formed around the cylindrical portion 35A, and the first gear 35 is pivotally supported on the side plate 3 through loose fit between the cylindrical portion 35A and the supporting shaft 38 which is projecting from the side plate 3.

The third gear 37 is engaged with a platen gear 16 fixed on a drive shaft 15A which supports a platen 15 of a printer body 14.

To the cylindrical portion 35A, a cam 39 with a projection 39A is loose fit. The cam 39 is pressed against one end 35C of the cylindrical portion 35A by a coiled spring 40 installed in the annular groove 35B of the first gear 35.

The side plate 3 has also a cam stopper 41 around the first gear 35. The cam stopper 41 is projecting therefrom and contacts with the projection 39A of the cam 39.

Thus, the gear stop lever 32 inhibits the clockwise revolution of the planetary gear 9 when the drive shaft 15A of the printer body 14 reversely rotates and does not inhibit the counterclockwise revolution of the planetary gear 9 when the drive shaft 15A normally rotates.

The operation of the third embodiment will be described below.

Figure 12:
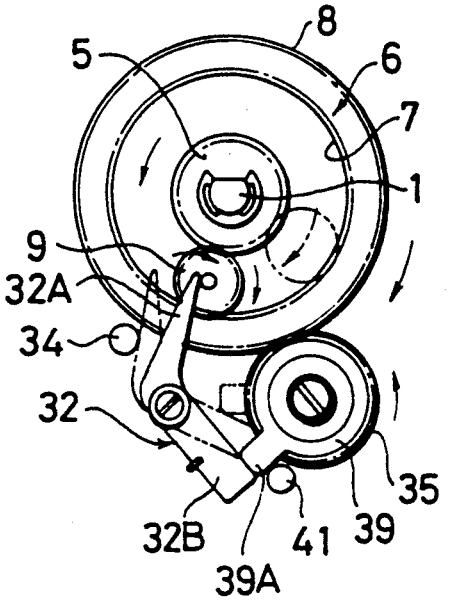
FIG. 12 is an explanatory view of the operating state of the third embodiment.

The third embodiment performs basic operations similar to those of the first embodiment and differences between them are described first with respect to the clutch-on state of the clutch device, referring to FIG. 12.

When the drive shaft 15A of the printer body 14 reversely rotates, the first gear 35 rotates counterclockwise. This rotation causes the counterclockwise rotation of the cam 39 which is drivingly coupled with the first gear 35 through the coiled spring 40. When the projection 39A pushes the other end 32B of the gear stop lever 32, the gear stop lever 32 located in the position shown by the two-dot chain line under pressure of the torsion spring 33 moves to another position shown by the solid line. Namely, the end 32A of the gear stop lever 32 gets into the revolution orbit of the planetary gear 9.

When the side of the projection 39A of the cam 39 contacts with the cam stopper 41, the cam 39 stops its rotation. In this state, the first gear 35 still continues to rotate counterclockwise.

The rotation of the first gear 35 causes the clutch gear 6 to rotate clockwise, and the planetary gear 9 engaged with the internal gear 7 of the clutch gear 6 to rotate clockwise on its axis as well as to revolve clockwise around the sun gear 5 which is inhibited from rotating.

When the planetary gear 9 finally contacts with the end 32A of the gear stop lever 32, its revolution is inhibited. The rotary driving force of the planetary gear 9 whose revolution is inhibited overcomes the rotary braking force of the sun gear 5 to rotate the sun gear 5 counterclockwise, which rotates the feeding roller shaft 1. Then, the feeding roller 2 begins to rotate in the feeding direction; the clutch device goes into the clutch-on state.

Next, the clutch-off state of the third embodiment will be described below, referring to FIG. 9.

When the drive shaft 15A of the printer body 14 normally rotates, the first gear 35 rotates clockwise. This rotation causes the clockwise rotation of the cam 39 which is drivingly coupled with the first gear 35 through the coiled spring 40 and the projection 39A becomes free of the other end 32B of the gear stop lever 32. This enables the gear stop lever 32 to recover the original position through rebound of the coiled spring 40, and the end 32A of the gear stop lever 32 leaves the revolution orbit of the planetary gear 9.

When the side of the projection 39A of the cam 39 contacts with the cam stopper 41 after the projection 39A rotates substantially one turn, the cam 39 stops its rotation. In this state, the cam 39 slips off the first gear 35, which continues to rotate clockwise.

The rotation of the first gear 35 causes the clutch gear 6 to rotate counterclockwise, and the planetary gear 9 engaged with the internal gear 7 of the clutch gear 6 to rotate counterclockwise on its axis as well as to revolve clockwise around the sun gear 5 which is inhibited from rotating under pressure of the pressure plate 4B shown in FIG. 3.

In addition, as the planetary gear 9 revolves, the sun gear 5 is in the stopped state and the feeding roller 2 also stops; the clutch device goes into the clutch-off state.

It will be appreciated that the third embodiment can have the same effect as that of the first embodiment.

Figure 14:
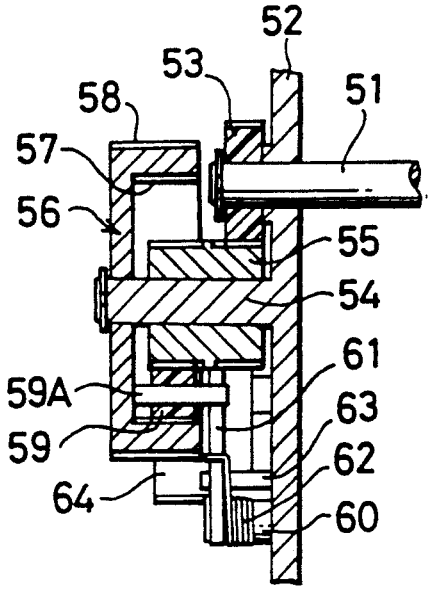
FIG. 14 is a cross section of a sun gear shown in FIG. 13 and some other parts around it.
Figure 13:
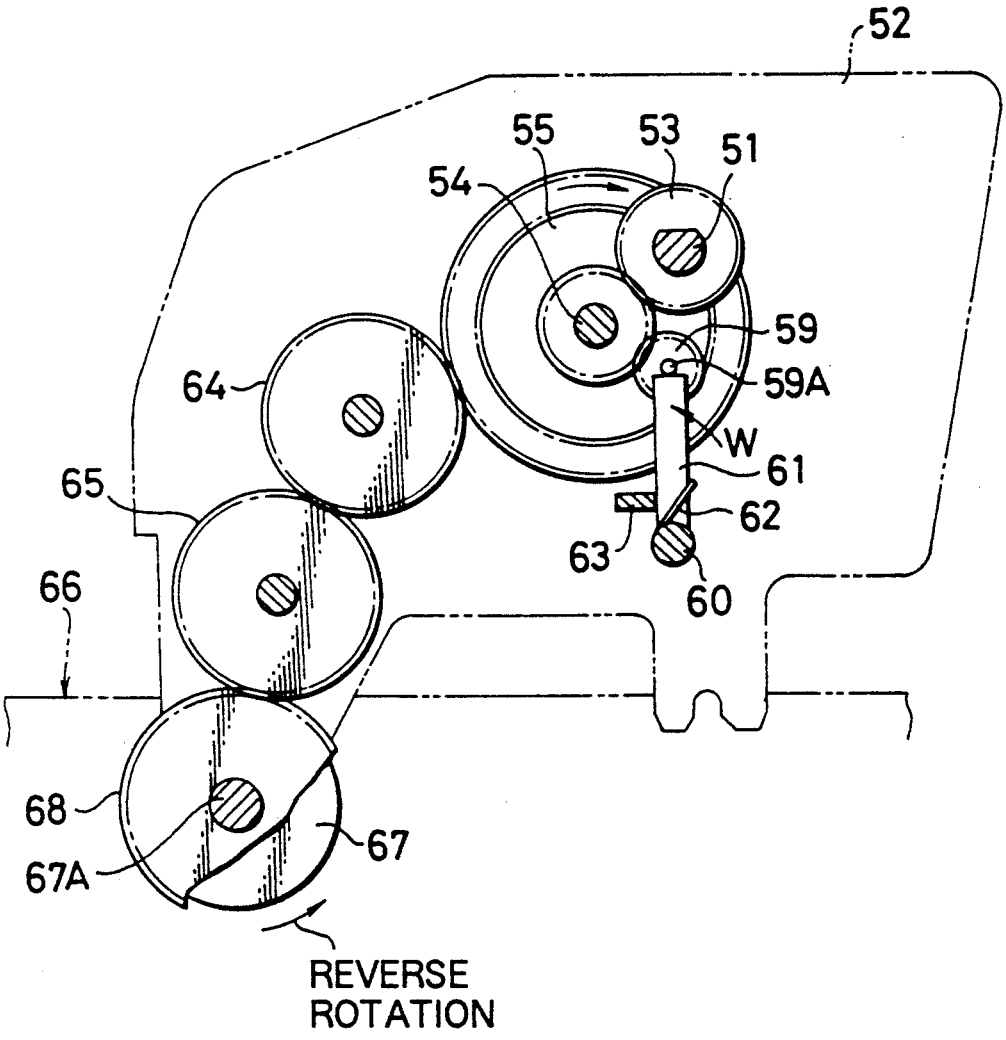
FIG. 13 is an elevational view in section of a clutch device for an automatic paper feeder according to the fourth embodiment of the present invention.

FIGS. 13 and 14 show another clutch device for an automatic paper feeder according to the fourth embodiment of the present invention.

In the drawings, the reference numeral 51 shows a feeding roller shaft, on which a feeding roller (not shown) is fixed and one end of which is rotatably supported by a side plate 52. The feeding roller shaft 51 has a feeding roller gear 53 fixed on its end portion outside the side plate 52.

The side plate 52 has a sun gear shaft 54 projecting therefrom and a sun gear 55 is rotatably provided on the sun gear shaft 54. The sun gear 55 is engaged with the feeding roller gear 53.

The sun gear shaft 54 has a clutch gear 56 rotatably provided thereon and the clutch gear 56 has an internal gear 57 formed on its inner surface and an external gear 58 formed on its outer surface.

The numeral 59 shows a planetary gear, which is engaged with both the internal gear 57 of the clutch gear 56 and the sun gear 55 and has a gear pin 59A projecting at its center.

The side plate 52 has a gear stopper stud 60 attached thereto and on the gear stopper stud 60, a gear stopper 61 formed of a bar is pivotally supported. The gear stopper stud 60 has a torsion spring 62 attached thereto and the torsion spring 62 pushes the gear stopper 61 in the direction shown by the arrow W so that the gear stopper 61 is held against another stopper 63 fixed on the side plate 52 to inhibit the gear rotation.

The side plate 52 has a first gear 64 engaged with the external gear 58 of the clutch gear 56 and a second gear 65 engaged with the first gear 64, each being axially supported on the side plate 52. The second gear 65 is engaged with a platen gear 68 fixed on a drive shaft 67A which supports a platen 67 of a printer body 66.

The stopper 61 inhibits the clockwise revolution of the planetary gear 59 when the drive shaft 67A of the printer body 66 reversely rotates and does not inhibit the counterclockwise revolution of the planetary gear 59 when the drive shaft 67A normally rotates.

Thus, when the drive shaft 67A of the printer body 66 reversely rotates, the clockwise revolution of the planetary gear 59 is inhibited. Therefore, the sun gear 55 rotates counterclockwise to rotate the feeding roller gear 53 clockwise, resulting in the clockwise (the feeding direction) rotation of the feeding roller shaft 51.

When the drive shaft 67A normally rotates, the feeding roller shaft 51 stops in a similar manner to the first embodiment.

It will be appreciated that the fourth embodiment can have the same effect as that of the first embodiment.

It will be further appreciated that the first, second, and fourth embodiments of the present invention do not use a torque limiter or any other part which increases rotary load for the on/off operations of the clutch. Accordingly, those embodiments can reduce the number of necessary parts as well as the load of a printer drive motor.

Although the invention has been described in its most preferred forms with a certain degree of particularity, it is understood that the present disclosure of the preferred forms has been changed in the details of construction and the combination and arrangement of the parts may be resorted to without departing from the spirit and scope of the invention as hereinafter claimed.

What is claimed is:

1. A clutch device for an automatic paper feeder which includes a feeding roller to hold uniform-size sheets of printing paper between a pressure plate and itself and which separates and feeds one by one to the attached printer through the rotation of said feeding roller, including:

a clutch gear which has an internal gear formed on its inner surface and an external gear formed on its outer surface, said external gear receiving rotary driving force transferred from a drive shaft of a printer body;

a sun gear which is located coaxially with said clutch gear to transfer rotary driving force to a feeding roller shaft supporting said feeding roller and to receive rotary braking force of a braking means;

a planetary gear which is engaged with both said internal gear of said clutch gear and said sun gear; and a stopper which inhibits said planetary gear from revolving in a predetermined direction during the reverse rotation of said drive shaft of said printer body but does not inhibit said planetary gear from revolving in the opposite direction to said predetermined direction during the normal rotation of said drive shaft.

2. A clutch device for an automatic paper feeder which includes a feeding roller to hold uniform-size sheets of printing paper between a pressure plate and itself and which separates and feeds them one by one to the attached printer through the rotation of said feeding roller, including:

a clutch gear which has an internal gear formed on its inner surface and an external gear formed on its outer surface, said external gear receiving rotary driving force transferred from a drive shaft of a printer body;

a sun gear which is located coaxially with said clutch gear to transfer rotary driving force to a feeding roller shaft supporting said feeding roller and to receive rotary braking force of a braking means;

a planetary gear which is engaged with said internal gear of said clutch gear and which moves in the longitudinal direction of said feeding roller shaft while it revolves within a predetermined range to be engaged with or disengaged from said sun gear; and a stopper which inhibits said planetary gear from revolving in a predetermined direction during the reverse rotation of said drive shaft of said printer body and inhibits said planetary gear from revolving in the opposite direction to said predetermined direction during the normal rotation of said drive shaft.

* * * * *